US006507262B1

(12) United States Patent
Otte et al.

(10) Patent No.: US 6,507,262 B1
(45) Date of Patent: Jan. 14, 2003

(54) MAGNETIC CORE THAT IS SUITABLE FOR USE IN A CURRENT TRANSFORMER, METHOD FOR THE PRODUCTION OF A MAGNETIC CORE AND CURRENT TRANSFORMER WITH A MAGNETIC CORE

(75) Inventors: Detlef Otte, Gründau (DE); Jörg Petzold, Bruchköbel (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/831,800

(22) PCT Filed: Nov. 15, 1999

(86) PCT No.: PCT/DE99/03631

§ 371 (c)(1),
(2), (4) Date: Aug. 15, 2001

(87) PCT Pub. No.: WO00/30132

PCT Pub. Date: May 25, 2000

(30) Foreign Application Priority Data

Nov. 13, 1998 (DE) ..... 198 52 424

(51) Int. Cl.[7] ..... H01F 27/24; H01F 27/02
(52) U.S. Cl. ..... 336/213; 336/83
(58) Field of Search ..... 336/83, 212, 178, 336/233; 148/108

(56) References Cited

U.S. PATENT DOCUMENTS

| | | | | | |
|---|---|---|---|---|---|
| 4,451,876 | A | * | 5/1984 | Ogata | 363/21 |
| 4,487,812 | A | * | 12/1984 | Kawasaki et al. | 428/629 |
| 5,725,686 | A | * | 3/1998 | Yoshizawa et al. | 148/307 |
| 5,922,143 | A | * | 7/1999 | Verin et al. | 148/108 |

FOREIGN PATENT DOCUMENTS

| | | |
|---|---|---|
| EP | 0271657 | 6/1988 |
| EP | 0563606 | 10/1993 |

* cited by examiner

*Primary Examiner*—Anh Mai
(74) *Attorney, Agent, or Firm*—Dean W. Russell; Kilpatrick Stockton LLP

(57) ABSTRACT

Magnetic cores including coiled amorphous ferromagnetic alloy strips in which at least fifty percent of the volume contains fine crystalline particles with an average particle size of 100 nm or less are addressed. The composition of the alloy essentially corresponds to the formula $Fe_aCo_bCu_cSi_dB_eM_f$, where M is at least one of the elements V, Nb, Ta, Ti, Mo, W, Zr, and Hf; and a, b, c, d, e, and f are indicated in atom percent and meet the following conditions: $0.5 \leqq c \leqq 2$; $6.5 \leqq d \leqq 18$; $5 \leqq e \leqq 14$; $1 \leqq f \leqq 6$; with $d+e>18$ and $0 \leqq b \leqq 15$, and $a+b+c+d+e+f=100$.

18 Claims, 4 Drawing Sheets

Typical Data:

$N_{prim}$ : 1...6
$I_{prim}$ :5 $A_{eff}$..120$A_{eff}$ (max.)
$N_{sec}$ : 500 ...4000
$I_{sec} \approx -I_{prim} * N_{prim} / N_{sec}$
$R_B$ : 1Ω ...200 Ω (Burden)
$R_{cu}$ :1Ω...200 Ω (Winding)
$U_{signal}$ : 300 $mV_{eff}$ (max.)
Frequency: 50 / 60 Hz

MAGNETIC CORE THAT IS SUITABLE FOR USE IN A CURRENT TRANSFORMER, METHOD FOR THE PRODUCTION OF A MAGNETIC CORE AND CURRENT TRANSFORMER WITH A MAGNETIC CORE

Magnetic core which is suitable for use in a current transformer, process for the production of a magnetic core, and current transformer with a magnetic core.

FIELD OF THE INVENTION

The invention concerns a magnetic core which is suitable for use in a current transformer, a process for the production of this type of magnetic core, and a current transformer with this type of magnetic core.

BACKGROUND OF THE INVENTION

To detect the energy consumption of electrical devices and facilities in industrial and household use, energy meters are used. The oldest principle in use in this regard is that of the Ferrari meter. The Ferrari meter is based on energy metering via the rotation of a disk, connected with a mechanical register, which is driven by the fields of appropriate field coils which are proportional to the current and/or the voltage. For the expansion of the functional possibilities of energy meters, such as for multi-rate operation or remote reading, energy meters are used in which the current and voltage detection is performed via inductive current and voltage transformers.

A special application, in which a particularly high exactitude is required, is the detection of energy currents in the utility company sector. In this case, the quantities of energy generated by the respective power plants and stored in the high-voltage networks must be precisely determined on one hand, and, on the other hand, the changing portions of consumption or supply in the traffic between the utility companies are of great importance for accounting. The energy meters used for this purpose are multifunction built-in devices whose input signals for current and voltage are taken from the respective high and medium high voltage installations via cascades of current and voltage transformers and whose output signals serve for digital and graphic registration and/or display as well as for control purposes in the control centers. In this regard, the first transformer on the network side serves for isolated transformation of the high current and voltage values, e.g. 1 to 100 kA and 10 to 500 kV, into values which can be handled in the control cabinets, while the second transformers transform these in the actual energy meter into the signal level necessary for the measurement electronics in the range of less than 10 to 100 mV.

FIG. 1 shows an equivalent circuit diagram of this type of current transformer and the range of technical data that can occur in various applications. A current transformer 1 is shown here. The primary winding 2, which carries the current $I_{prim}$ to be measured, and a secondary winding 3, which carries the measured current $I_{sec}$ are located on a magnetic core 4, which is made from an amorphous soft-magnetic band. The secondary current $I_{sec}$ automatically establishes itself in such a way that the primary and secondary ampere turns are, in the ideal case, of equal size and aligned in opposite directions. The trace of the magnetic fields in this type of current transformer is illustrated in FIG. 2, with losses in the magnetic core not considered. The current in the secondary winding 3 enestablishes itself according to the law of induction in such a way that it seeks to impede the cause of its occurrence, namely the temporal change of the magnetic flux in the magnetic core 4.

In the ideal current transformer, the secondary current is, when multiplied with the turns ratio, therefore equal to the negative of the primary current, which is illustrated by equation (1):

$$I_{sec}^{ideal} = -I_{prim} * (N_{prim}/N_{sec}) \tag{1}$$

This ideal case is never achieved, due to the losses in the burden resistance 5, in the copper resistance 6 of the secondary winding, and in the magnetic core 4.

Therefore, in the real current transformer, the secondary current has an amplitude error and a phase error relative to the above idealization, which is described by equation (2):

$$\begin{aligned} &\textit{Amplitudenfehler: } F(I) = \frac{I_{\sec}^{real} - I_{\sec}^{ideal}}{I_{\sec}^{ideal}}; \\ &\textit{Phasenfehler: } \varphi(I) = \phi(I_{\sec}^{real}) - \phi(-I_{prim}) \end{aligned} \tag{2}$$

The output signals of this type of current transformer are digitized, multiplied, integrated, and saved. The result is an electrical value which is available for the purposes mentioned.

The electronic energy meters used for energy metering in these applications operate "indirectly," so that only purely bipolar, zero-symmetric alternating currents must be measured in the meter itself. Current transformers which are assembled from magnetic cores made of highly permeable materials and which must be equipped with very many secondary turns, i.e., typically 2500 or more, to achieve lower measurement error via a smaller phase error ψ, serve for this purpose.

For the mapping of purely bipolar currents, current transformers are known whose magnetic cores consist of highly permeable crystalline alloys, particularly nickel-iron alloys, which contain approximately 80 weight-percent nickel and are known under the name "Permalloy." These have a phase error ψ which is fundamentally very low. However, they also have the disadvantage that this phase error ψ varies strongly with the current $I_{prim}$ to be measured, which is identical with the modulation of the transformer core. For a precise current measurement with changing loads, a costly linearization in the energy meter is therefore necessary with these transformers.

Furthermore, current transformers are known which operate based on ironless air-core coils. This principle is known as the Rogowski principle. In this way, the influence of the modulation on the phase error does not apply. Because the requirements for reliability of this type of current transformer must be very high in order to allow energy metering which can be calibrated, these designs are equipped with costly shields against external fields, which requires a high outlay for materials and assembly and is therefore cost intensive.

Furthermore, solutions are known in which a ferrite pot core provided with an air gap (gapped) is used as the magnetic core. This current transformer has very good linearity, however, due to the relatively low permeability of the ferrite, a very high number of turns in connection with a very large-volume magnetic core is required in order to achieve a low phase angle in the current transformer. Furthermore, this current transformer based on ferrite pot cores also has a high sensitivity to external interfering fields, so that shielding measures must also be taken here. In addition, the magnetic values of ferrites are, as a rule, strongly temperature dependent.

SUMMARY OF THE INVENTION

The invention has as its object the specification of a magnetic core which, when used in a current transformer, allows higher measurement accuracy of a current to be measured than the prior art, while simultaneously having an economical implementation and a compact overall size. Furthermore, a process for the production of this type of magnetic core and a current transformer with this type of magnetic core are to be specified. In addition, the temperature dependency of the properties should be as small as possible.

The object is achieved by a magnetic core suitable for use in a current transformer characterized in that it consists of a wound band made of a ferromagnetic alloy in which at least 50% of the alloy is occupied by fine crystalline particles with an average particle size of 100 nm or less (nanocrystalline alloy), it has a saturation permeability which is larger than 12,000, preferably 20,000, and smaller than 300,000, preferably 350,000, it has a saturation magnetostriction whose amount is smaller than 1 ppm, it is essentially free from mechanical stress, and it has a magnetic anisotropic axis along which the magnetization of the magnetic core aligns itself particularly easily and which is orthogonal to a plane in which a center line of the band runs. The alloy has a composition which essentially consists of the formula $$Fe_aCo_bCu_cSi_dB_eM_f$$

wherein M is at least one of the elements V, Nb, Ta, Ti, Mo, W, Zr, and Hf, a, b, c, d, e, f are indicated in atom %, and a, b, c, d, e, and f meet the following conditions:

$0.5 \leqq c \leqq 2$; $6.5 \leqq d \leqq 18$; $5 \leqq e \leqq 14$; $1 f \leqq 6$; with $d+e>18$ and $0 \leqq b \leqq 15$, whereby $a+b+c+d+e+f=100$.

The permeability relates to an applied field strength, which lies in the plane in which the center line of the band lies, and the induction hereby produced.

It has been shown that in this type of magnetic core the dependence of the permeability on the magnetization is very small. The hysteresis loop of the magnetic core is therefore very narrow and linear. This requires the smallest possible ratio of remanence induction to saturation induction of, if possible, less than 5%, and small coercive field strengths of, if possible, less than 10 mA/cm, preferably 5 mA/cm.

Because the permeability is, at over 12,000, very large and in addition is essentially independent from the magnetization, the absolute phase error and the absolute amplitude error of a current transformer with this type of magnetic core are very small. The absolute amplitude error can be smaller than 1‰. The absolute phase error can be smaller than 0.1°.

In addition to the magnetic core, the current transformer has at least one primary winding and one secondary winding, to which a burden resistance is connected in parallel and which terminates the secondary electric circuit at a low resistance.

Furthermore, it has been shown that the hysteresis loop of the magnetic core has a high linearity. Thus, a permeability ratio $\mu_{15}/\mu_4$ is less than 1.1 and a permeability ratio $\mu_{10}/\mu_{0.5}$ is less than 1.1, with $\mu_{0.5}$, $\mu_4$, $\mu_{10}$, and $\mu_{15}$ being the permeabilities at a field amplitude H of 0.5, 4, 10, and 15 mA/cm.

Due to the good linearity, the phase and the amplitude errors have essentially no dependence on the current to be measured. Due to the high saturation induction of, for example, 1.2 Tesla, this applies, in contrast to other soft-magnetic, highly permeable materials, to a broader range of field strength and/or induction.

Because the absolute phase error, the absolute amplitude error, and the dependence of the errors on the current to be measured are very small, a very exact current detection can be performed through the current transformer.

Due to the nanocrystalline structure, the magnetic core has a surprisingly high aging resistance, which allows an upper limit on the usage temperature for the magnetic core of over 120° C., in some cases even around 150° C. In this way, the current transformer with the magnetic core is particularly suitable for usage well above room temperature.

The properties of the magnetic core are only weakly temperature dependent, with this dependency in turn running extensively linearly.

The invention is based on the knowledge that, with the alloy of the composition described, a magnetic core with the properties described can be produced through a suitable heat treatment. Very many parameters are thereby adjusted relative to one another so that the magnetic core has the properties described.

Due to the nanocrystalline two-phase structure produced during the heat treatment, the two basic requirements for good soft-magnetic properties are fulfilled, with the simultaneous provision of high saturation induction and higher thermal stability:

1) Elimination, i.e., averaging of the crystal anisotropy $K_1$ through the smoothing effect of the ferromagnetic exchange interaction, which overreaches the particles.
2) The greatest possible establishment of the zero crossing of the saturation magnetostriction $\lambda_s$ ($\lambda_s$<1 ppm) through superposition of the magnetostriction contributions of both the nanocrystalline grains and the amorphous intergranular residual phase.

Because the remaining interfering anisotropies in the band and/or magnetic core can be hereby eliminated down to approximately 2 J/m$^3$ or even less, even for very small uniaxial transverse anisotropies induced by a magnetic field, highly linear hysteresis loops (F-loops) with the highest permeabilities can be produced.

In the following, a heat treatment, which is a process for the production of a magnetic core and which also achieves the object, will be described:

After production and winding of the band for the magnetic core, the magnetic core is heated to a target temperature between 450° C. and 600° C. The target temperature preferably lies above 520° C. In this way, proceeding from an amorphous condition of the band, the nanocrystalline two-phase structure is formed.

After the nanocrystalline two-phase structure is implemented, in order to form the anisotropic axis, a magnetic field of at least 100 A/cm, which is transverse to the direction of the wound band (transverse field), is switched on at a temperature below the Curie temperature of the alloy. This transverse field must be large enough that the core is in the condition of its saturation induction in the direction of the anisotropic axis to be implemented. The Curie temperature is the temperature at which a spontaneous magnetization of the alloy begins.

The target temperature is selected so that it lies above the crystallization temperature of the alloy. It is tailored to the composition of the alloy in such a way that, due to the particle size distribution to be established and the volume filling of the particles, the best possible averaging of the crystal anisotropy $K_1$ occurs. Simultaneously, the magnetostriction contributions of the nanocrystalline particles and the amorphous residual phase should balance one another in such a way that the resulting saturation magnetostriction is very small or disappears completely as much as possible.

Simultaneously, the heating causes a reduction of mechanical stresses in the band and in the wound magnetic core, so that the development of the nanocrystalline grains occurs in the stress-free condition and no stress-induced anisotropies can develop.

A particularly high linearity of the hysteresis loops can be achieved if the ratio of the mechanical elastic stress tensor of the magnetic core, multiplied with the saturation magnetostriction, to the uniaxial anisotropy is smaller than 0.5.

The field strength of the magnetic field applied orthogonally to the wound band (transverse field) is selected in such a way that it is significantly larger than the field strength necessary to achieve the saturation induction in this direction of the core. As a rule, this is more than 100 A/cm.

In the framework of the invention, two sequential heat treatments are performed. The first heat treatment serves for the formation of the nanocrystalline two-phase structure. The second heat treatment can be performed at a lower temperature than the first heat treatment and serves for the implementation of the anisotropic axis. Alternatively, first the nanocrystalline two-phase structure is formed and then the anisotropic axis is induced in the same heat treatment.

If, for example, permeabilities in the lower range of the indicated window of 12,000–300,000 are required, the production of the nanocrystalline structure and the implementation of the anisotropic axis can also occur simultaneously. For this purpose, the magnetic core is heated to the target temperature, held there until the nanocrystalline structure is formed, and then cooled back down to room temperature. Depending on the permeability required, the transverse field is either applied during the entire heat treatment or switched on only after the target temperature is reached or even later.

The heating to the target temperature is performed as quickly as possible. For example, the heating to the target temperature is performed at a rate between 1 to 15 K/min. To achieve an internal temperature equalization in the core, a delayed heating rate below 1 K/min or even a temperature plateau of several minutes can be applied in the temperature region where crystallization begins.

The magnetic core is, for example, kept at the target temperature of about 550° C. between 4 minutes and 8 hours in order to achieve particles which are a small as possible with homogenous particle size distribution and small intergranular intervals. The temperature selected is hereby higher the lower the Si content in the alloy is. In this regard, the setting in of non-magnetic boride phases or the growth of surface crystallites on the band represents, for example, an upper limit for the target temperature.

To establish the anisotropic axis, and thereby the linear hysteresis loop (F-loop) the magnetic core is held below the Curie temperature, e.g. between 260° C. and 590° C., for between 0.1 and 8 hours, with the transverse magnetic field switched on. The uniaxial anisotropy hereby induced is larger the higher the temperature selected in the transverse field. The permeability level is reciprocal to this, so that the highest values develop at the lowest temperatures. The core is subsequently cooled at, for example, 0.1 to 5 K/min in the applied transverse field to room temperature values of, e.g., 25° C. or, e.g., 50° C. On one hand, this is advantageous for economic reasons, on the other hand, field-free cooling cannot be performed below the Curie temperature for reasons of linearity.

The magnetic field can be switched on during the entire heat treatment.

The composition of the alloy is selected in such a way that, on one hand, the best possible averaging of the crystal anisotropy of the nanocrystalline particles occurs, but, on the other hand, the zero crossing of the saturation magnetostriction is achieved as well as possible. However, at the same time the metalloid content cannot be set too high, because in this way the band becomes brittle and castability, windability, and cuttability of the band are lost. On the other hand, however, the crystallization temperature should be as high as possible, so that, e.g., no nuclei for surface crystallites, which are extremely harmful to the linearity of the loop, arise during the casting process of the band. The latter condition can be attained within certain limits through, e.g., increased content of B and/or Nb.

Due to the high permeability the current transformer can have both exact current detection and a particularly small volume.

A further improvement in regard to the linearity of the hysteresis loop of the magnetic core and thereby the response of the current transformer can be achieved if the magnetic core has a magnetostriction value $|\lambda_s|<0.2$ ppm and the magnetic core contains a nanocrystalline ferromagnetic alloy having a composition which essentially consists of the formula $$Fe_aCo_bCu_cSi_dB_eM_f$$

wherein M is at least one of the elements V, Nb, Ta, Ti, Mo, W, Zr, and Hf, a, b, c, d, e, f are indicated in atom %, and a, b, c, d, e, and f meet the following conditions:

$c=1$; $14 \leqq d \leqq 17$; $5 \leqq e \leqq 14$; $2 \leqq f \leqq 4$; with $22 \leqq d+e \leqq 24$ and $0 \leqq b \leqq 0.5$, whereby $a+b+c+d+e+f=100$.

The alloy systems described above are distinguished by very linear, distinctly narrow hysteresis loops and, depending on the uniaxial anisotropy $K_u$ established at a field amplitude of H=4 mA/cm, have a permeability from $12{,}000<\mu_4<300{,}000$. In FIG. 3, hysteresis loops from magnetic cores made of a few of the alloy systems mentioned above are shown. These alloy systems are almost free from magnetostriction. The magnetostriction is preferably established by a heat treatment so that linear hysteresis loops with an ample usable induction range, due to the high saturation induction of $B_S$=1.1 to 1.4 T, and a very good frequency response relative to the permeability and low hysteresis losses can be produced.

In the preferred nanocrystalline alloy systems described above, through an exactly equalized function of temperature and holding time, use is made of the circumstance that, in the alloy compositions used according to the invention, the magnetostriction contributions of the fine crystalline particles and the amorphous residual phase balance and the required freedom from magnetostriction occurs.

The magnetic core preferably does not have an air gap. A current transformer with a magnetic core without an air gap has a particularly high immunity to external interfering magnetic fields without additional shielding measures. The magnetic core is, for example, a closed ring core, oval core, or rectangular core without an air gap. If the band has an axis of rotational symmetry, as in the case of the ring core, then the anisotropy axis is parallel to the axis of rotational symmetry. In any case, this anisotropic axis is as exactly orthogonal as possible to the direction of the wound band.

To produce the magnetic core, the band can be wound in a round shape and, if necessary, brought into the appropriate shape by means of suitable shaping tools during the heat treatment.

Particularly small coercive field strengths and thereby a particular good linearity of the hysteresis loop are achieved if the band is provided on at least one surface with an electrically insulating film. On one hand, this causes an improved relaxation of the magnetic core, on the other hand, particularly low eddy current losses can also be achieved.

The band is, for example, provided with the electrically insulating film on at least one of its two surfaces before winding. For this purpose, depending on the requirements of the materials of the insulating layer, an immersion, pass-through, spray, or electrolysis process is used on the band.

Alternatively, the wound magnetic core is subject to an immersion insulation before heating to the target temperature, so that the band is provided with the electrically insulating film. An immersion process in a partial vacuum has proven to be particularly advantageous.

In the selection of the insulating medium, care must be taken that, on one hand, it adheres well to the band surface, and, on the other hand, it does not cause any surface reactions which could lead to damage of the magnetic properties. For the alloys under discussion here, oxides, acrylates, phosphates, silicates, and chromates of the elements calcium, magnesium, aluminum, titanium, zirconium, hafnium, and silicon have proven to be effective and compatible insulators. Magnesium is particularly effective in this regard when it is applied as a fluid preproduct containing magnesium onto the band surface and transforms itself into a dense film containing magnesium, whose thickness D can lie between 25 nm and 3 $\mu$m, during a special heat treatment, which does not influence the alloy. At the temperatures of the magnetic field heat treatment described above, the actual insulator film made of magnesium oxide is then formed.

The secondary winding of the current transformer can have a number of turns which is smaller than or equal to 2200. The primary winding of the current transformer can have a number of turns which is equal to 3. The current transformer can be designed for a primary current which is smaller than or equal to 20A.

The band is first produced in an amorphous condition by means of rapid solidfication technology, as it is described, for example, in EP 0 271 657 B1, and then wound without stress on special machines into the magnetic core in its final dimensions. Due to the high linearity requirements of the hysteresis loop of the magnetic core, particular care is preferably applied in regard to freedom from stress.

The band is preferably produced in such a way that it has a small effective peak-to-valley depth. A particularly good remanence ratio and thereby a particular good linearity of the current transformer can thereby be achieved. It has been shown that 7% is particularly good as an upper limit for the effective peak-to-valley depth, with, however, the dispersion as well as the amount of remanence becoming smaller with decreasing peak-to-valley depth and thereby the stability of the linearity significantly increasing.

The heat-to-valley depth of the surfaces of the band, and also the band thickness, are significant influencing dimensions on the magnetic properties. The effective peak-to-valley depth is decisive.

The effective peak-to-valley depth is understood to be the sum of the average peak-to-valley depths $R_a$ of the two opposite band surfaces divided by the band thickness. FIG. 4 shows very graphically that the remanence ratio and thereby the linearity of the current transformer can be adjusted by adjusting the peak-to-valley depths.

Particularly uniform and linear hysteresis loops are achieved when several magnetic cores are stacked up exactly on their faces in the magnetic field during the heat treatment in such a way that the stack height is a multiple of the magnetic core external diameter. The hysteresis loop thereby develops more steeply the lower the temperature in the magnetic transverse field is set.

Depending on the alloy, the heat treatment is to be performed in vacuum or in an inert or reducing protective gas. In all cases, clean conditions specific to the material are to be considered, which in some cases are to be produced through appropriate additives such as absorber or getter materials specific to the element.

After the heat treatment, the magnetic core is finally hardened, e.g. through impregnation, coating, envelopment with suitable plastic materials and/or encapsulation, and is provided with at least one of the secondary windings of the current transformer.

In the following, an exemplary embodiment of the invention is described with reference to the figures.

BRIEF DESCRIPTION OF THE DRAWINGS

FIG. 7 is not to scale.

In an exemplary embodiment, a ring-shaped magnetic core M weighing 3 g was made, which consists of a band B made of a heat treated nanocrystalline alloy with the composition $Fe_{73.42}Cu_{1.04}Nb_{2.96}Si_{15.68}B_{6.95}$ coated with an approximately 300 nm thick insulating layer S, with the dimensions 19×15×5.2 mm and with an iron cross-section of $A_{Fe}$=0.077 cm$^2$.

DETAILED DESCRIPTION

To prevent winding stresses, care was taken during the winding of the band B into the magnetic core M that the tensile force of the band B was continually reduced as the number of band layers increased. In this way it was ensured that the torque acting tangentially on the magnetic core M remained constant over the entire radius of the magnetic core M and did not become larger with increasing radius.

To achieve the required magnetic properties, the magnetic core M was pretreated at 572° C., whereby, due to the formation of the nanocrystalline two-phase structure, the amount of saturation magnetostriction was reduced from $\lambda_s$≈24 ppm to 0.16 ppm. The heating rate was reduced between 450° C. and 520° C. from, for example, 10 K/min to 1 K/min. After the core was held at 572° C. for, e.g., 1 hour, it was cooled further.

Figure 7:
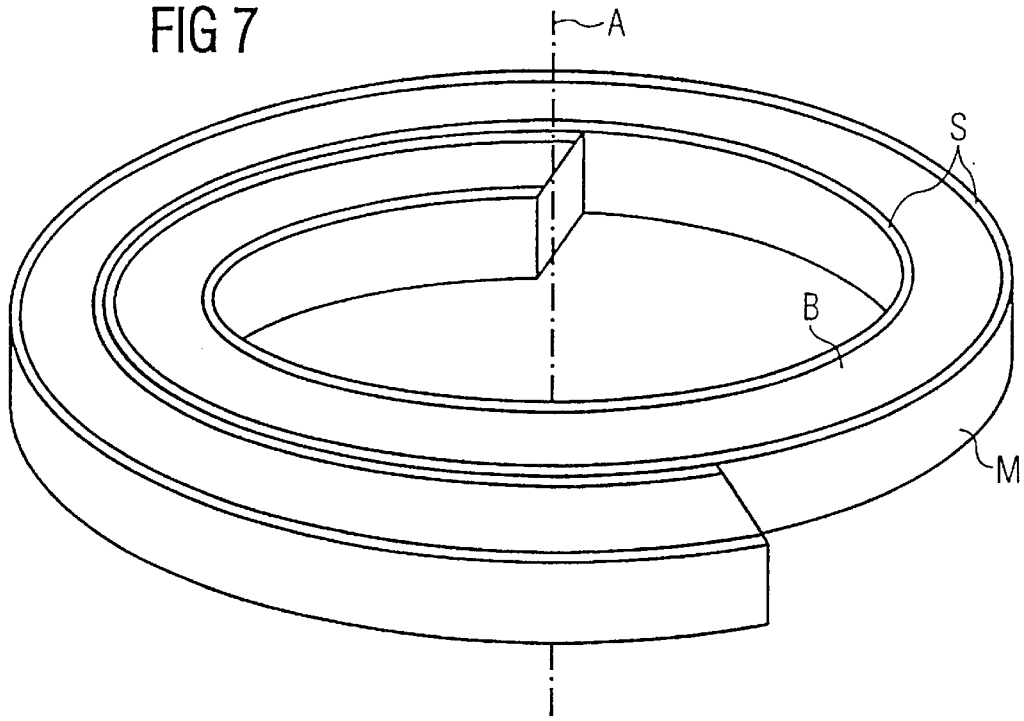
FIG. 7 schematically shows the magnetic core, which consists of a band with an insulating layer, and its anisotropic axis.

To establish the uniaxial transverse anisotropy $K_u$ necessary for flat linear hysteresis loops (F-loops), the magnetic core M was tempered in a further heat treatment for 3.5 hours at a temperature of 382° C. To align the preferred magnetic direction, i.e., to generate an anisotropic axis A, an external magnetic field (H>1000 A/cm) was applied, transverse to the later direction of magnetization, which was transverse to the direction of the wound band B (cf. FIG. 7). The magnetic field was thus parallel to the anisotropic axis A.

Figure 1:
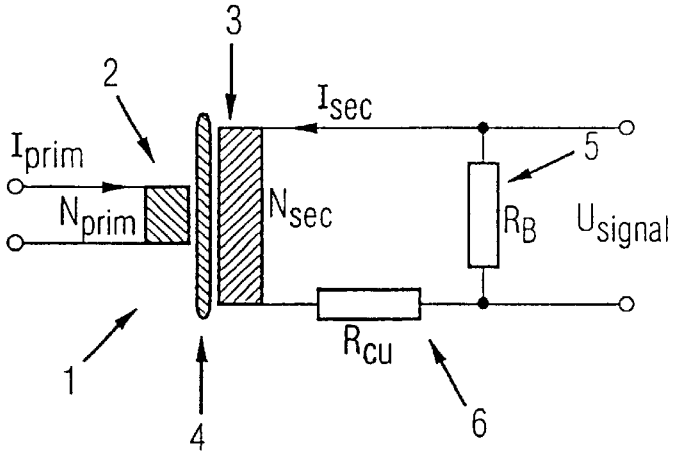
FIG. 1 provides an equivalent circuit diagram for a type of current transformer.
Figure 2:
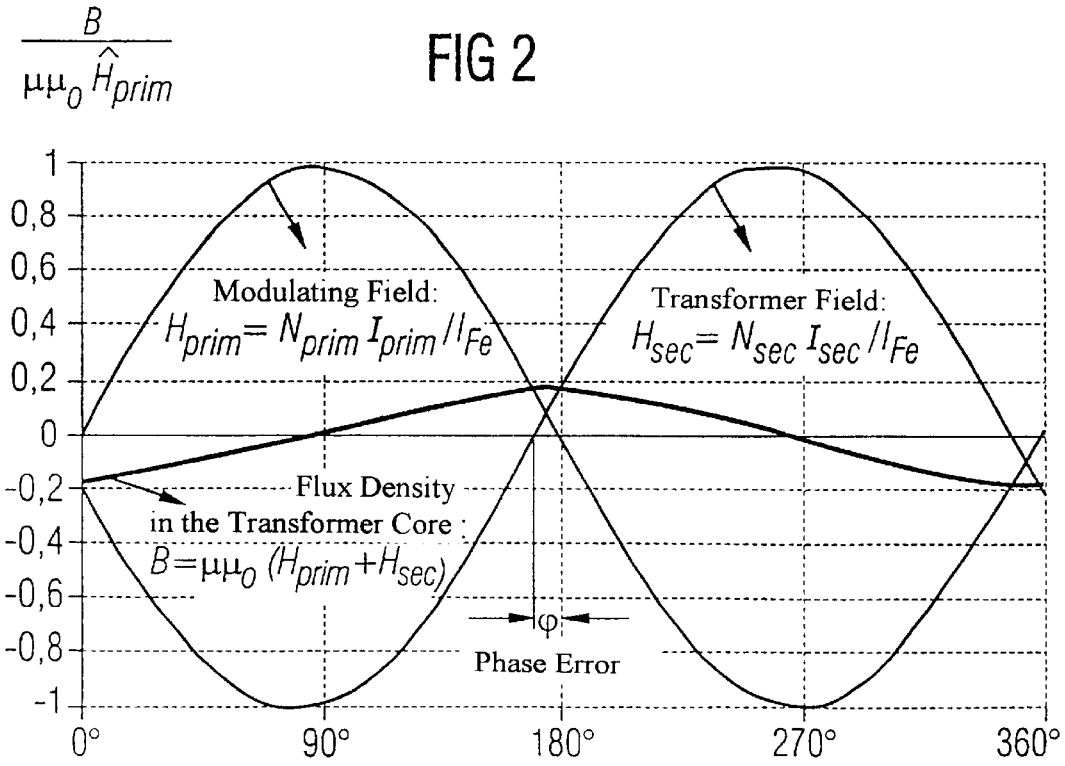
FIG. 2 illustrates a trace of the magnetic field in the type of current transormer whose equivalent circuit diagram is depicted in FIG. 1.
Figure 3:
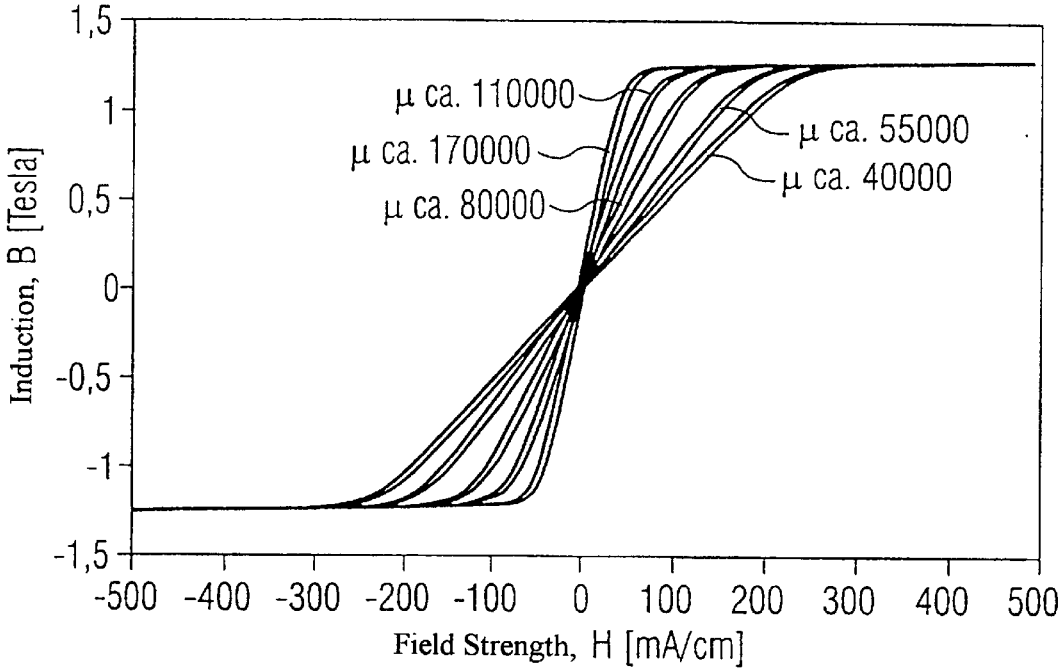
FIG. 3 provides a graph of induction as a function of field strength.
Figure 4:
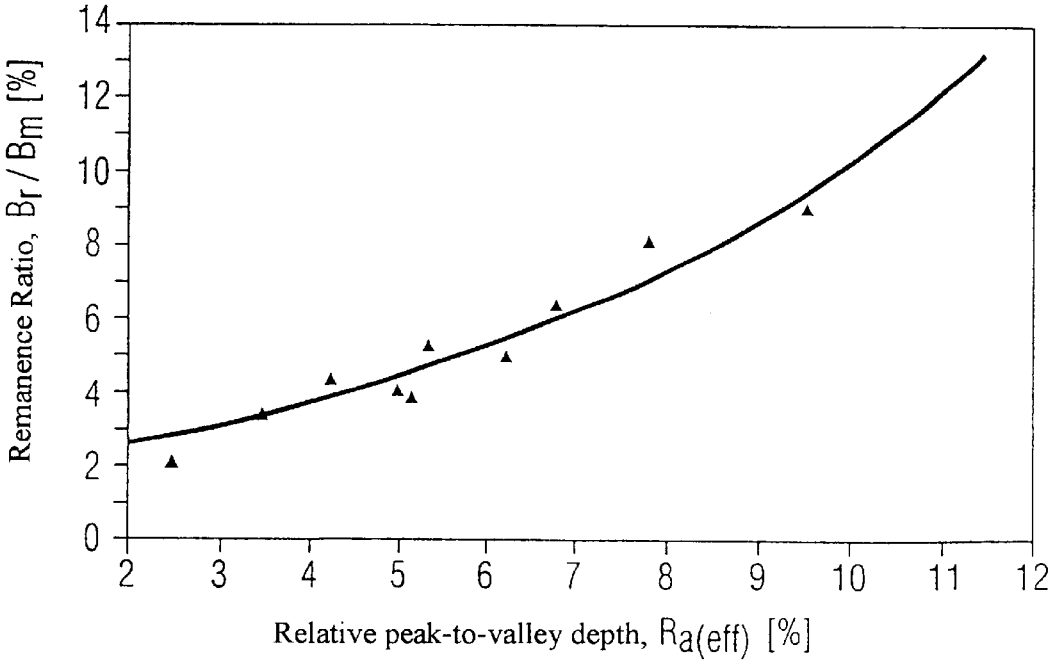
FIG. 4 provides a graph of remanence ratio as a function of relative peak-to-valley depth.
Figure 5:
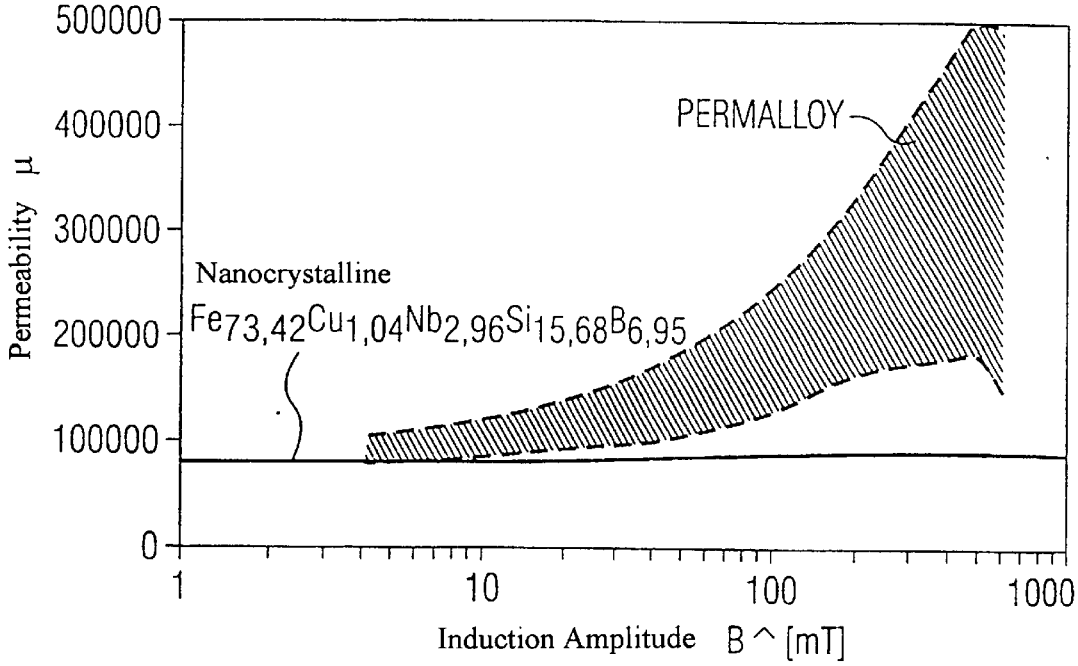
FIG. 5 shows a comparison of the dependence of the permeabilities of the magnetic core according to the invention and those of Permalloy cores on an induction amplitude which is produced through an exciting magnetic field.

The magnetic properties of the two-part heat-treated magnetic core M are indicated in FIG. 5, with the permeability, in contrast to conventional crystalline Permalloy cores, almost constant at the high value $\mu \approx 82{,}000$ over a wide modulation range. This was possible because, on one hand, the alloy used had a high saturation induction of approximately 1.2 Tesla and, on the other hand, the statistical ratio of remanence to saturation induction was sufficiently small due to the adequately strongly reduced saturation magnetostriction and a smaller effective peak-to-valley depth ($R_{a(eff)} \approx 2.9\%$) with $B_r/B_m = 2.6\%$.

Figure 6:
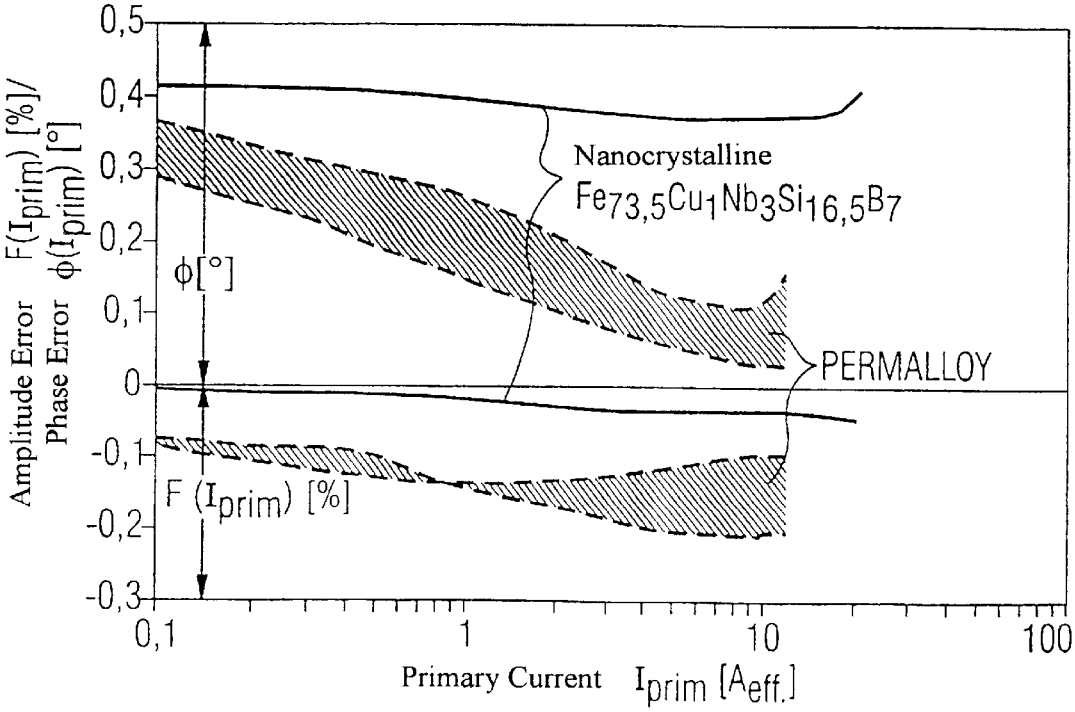
FIG. 6 shows the dependence of the amplitude error and the phase error on the current to be measured.

The magnetic core M was further processed into a current transformer. The current transformer had a primary number of turns $N_1$ of 3 and a secondary number of turns $N_2$ of 2000 and was terminated at low resistance via a burden resistance of 100 Ohm into the secondary current loop. The dimensions of the amplitude error F and the phase error $\phi$ relevant for the application are indicated in FIG. 6. Conditioned by the pronounced linearity and high permeability of the hysteresis loops, the amounts of both dimensions are small and their dependence on the modulation is relatively slight. The average phase angle $\phi$ is 0.40°. A linearity of the phase angle Acp over a current range of 0.1 to 2 A is less than 0.04°.

Figure 8:
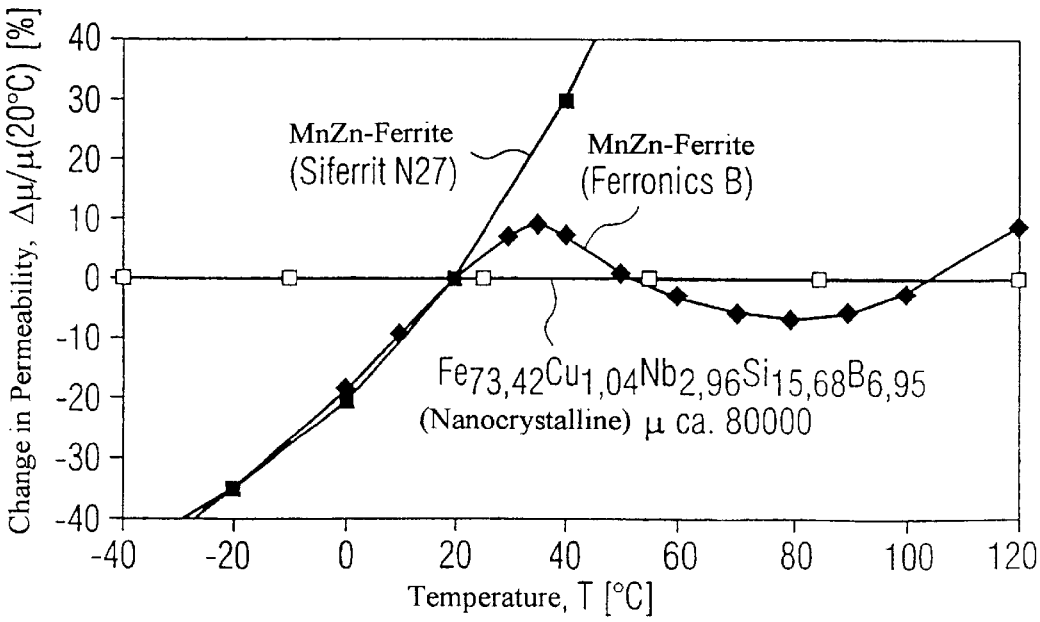
FIG. 8 shows the temperature dependence of the permeabilities of the magnetic core at a permeability level of approximately 80,000 in comparison with several typical ferrites.

The magnetic core M has an outstanding resistance to aging up to 150° C. In addition, FIG. 8 shows the outstandingly small temperature dependence of the magnetic core M produced from the nanocrystalline alloy discussed, with the established permeability level of 80,000 being particularly noticeable.

Overall, this annealing result was practically independent from whether the heat treatment described was performed in two independent partial steps or in one single sequence.

For even more complete reduction of the magnetostriction, the thermal pretreatment was performed at $T_x$=600° C. as an experiment. The result of annealing was, however, significantly worse, for in contrast to the outstanding linearity properties described above, the loop suddenly had a high remanence ratio of $B_r/B_m$=23.5%, with the initial permeability at only $\mu_4 \approx 48{,}000$.

After a pretreatment at $T_x$=520° C., the magnetic properties of the magnetic core reacted very sensitively to mechanically stressing influences of any type due to the higher saturation magnetostriction. The remanence ratio thereby grew, even with weak mechanical manipulations, from 6% to 20% or more. As a consequence, encapsulation or plastic coating, and thereby further technological processing of the magnetic core into a current transformer component, were no longer possible.

If, in contrast, the pretreatment temperature of $T_x$=572° C. was retained, but the temperature of the field heat treatment was increased to 440° C., the hysteresis loop did retain its outstanding linearity with a remanence ratio of $B_r/B_m$=2.4%, but its initial permeability was only $\mu_4 \approx 56{,}000$ due to a uniaxial anisotropy energy $K_U$ which was too high.

What is claimed is:

1. Magnetic core suitable for use in a current transformer, characterized in that it consists of a wound band (B) made of an amorphous, ferromagnetic alloy, in which at least 50% of the volume of the alloy is occupied by fine crystalline particles with an average particle size of 100 nm or less (nanocrystalline alloy), it has a permeability which is larger than 12,000 and smaller than 300,000, it has a saturation magnetostriction whose amount is smaller than 1 ppm, it is essentially free from mechanical stress, it has an anisotropy axis (A) along which the magnetization of the magnetic core (M) aligns itself particularly easily and which is orthogonal to a plane in which a center line of the band (B) runs, the alloy has a composition which essentially consists of the formula $$Fe_aCo_bCu_cSi_dB_eM_f$$

wherein M is at least one of the elements V, Nb, Ta, Ti, Mo, W, Zr, and Hf, a, b, c, d, e, f are indicated in atom %, and a, b, c, d, e, and f meet the following conditions:

$0.5 \leqq c \leqq 2$; $6.5 \leqq d \leqq 18$; $5 \leqq e \leqq 14$; $1 \leqq f \leqq 6$; with $d+e>18$ and $0 \leqq b \leqq 15$, whereby $a+b+c+d+e+f=100$.

2. Magnetic core according to claim 1, characterized in that a, b, c, d, e, and f meet the following conditions:

$c=1$; $14 \leqq d \leqq 17$; $5 \leqq e \leqq 14$; $2 \leqq f \leqq 4$; $0 \leqq b \leqq 0.5$; with $22 \leqq d+e \leqq 24$.

3. Magnetic core according to claim 2, characterized in that the amount of the saturation magnetostriction is smaller than 0.2 ppm.

4. Magnetic core according to claim 1, characterized in that the magnetic core (M) has a saturation magnetization $B_S$ of 1.1 to 1.4 T.

5. Magnetic core according to claim 1, characterized in that the band (B) has a peak-to-valley depth $R_{a(eff)}$ smaller than 7%.

6. Magnetic core according to claim 1, characterized in that the band (B) is provided on at least one surface with an electrically insulating film (S).

7. Magnetic core according to claim 6, characterized in that a film made of magnesium oxide is provided as the electrically insulating film (S).

8. Magnetic core according to claim 7, characterized in that the electrically insulating film (S) has a thickness D of 25 nm $\leqq D \leqq 3$ $\mu$m.

9. Magnetic core according to claim 1, characterized in that it is implemented as a closed ring core, oval core, or rectangular core without an air gap.

10. Magnetic core according to claim 1, characterized in that the ratio of its mechanical elastic stress tensor, multiplied with the saturation magnetostriction, to its uniaxial anisotropy is smaller than 0.5.

11. Current transformer for alternating current with a magnetic core according to claim 1, wherein the current transformer consists, in addition to the magnetic core (M) as a transformer core, of at least one primary winding and at least one secondary winding, to which a burden resistance is connected in parallel and which terminates the secondary current loop at a low resistance.

12. Current transformer according to claim 11, characterized in that the secondary winding has a number of turns $N_{sec} \leqq 2200$, with the primary winding having a number of turns $N_{prim}=3$ and the current transformer designed for a primary current $I_{prim} \leqq 20$ A.

13. Process for the production of a magnetic core according to claim 1, wherein, after production and winding of the band (B) into the magnetic core (M), the magnetic core (M) is heated to a target temperature between 450° C. and 600° C., wherein the magnetic core (M) is subject to a magnetic field of more than 100 A/cm which is parallel to the anisotropic axis (A) of the magnetic core (M) to be implemented, at a temperature below the Curie temperature of the alloy, for 0.1 to 8 hours at temperatures between 260° C. and 590° C.

14. Process according to claim 13, wherein the heating to the target temperature is performed at a rate between 0.5 and 15 K/min, wherein the magnetic core (M) is held at the target temperature between 4 minutes and 8 hours.

15. Process according to claim 13, wherein the band (B) is provided on at least one of its two surfaces with an electrically insulating film (S) before winding.

16. Process according to claim 13, wherein the magnetic core (M) is subjected to an immersion insulation before heating to the target temperature, so that the band (B) is provided with an electrically insulating film (S).

17. Process according to claim 13, wherein at least during the treatment in the magnetic field, several identical magnetic cores (M) are stacked on one another on their faces in such a way that a stack height is a multiple of the external diameter of the magnetic core (M).

18. Process according to claim 13, wherein the magnetic core (M) is cooled to room temperature at rates from 0.1 to 5 K/min.

* * * * *